United States Patent [19]

Chao et al.

[11] Patent Number: 4,516,566

[45] Date of Patent: May 14, 1985

[54] SEPARATION OF ARABINOSE BY SELECTIVE ADSORPTION ON ZEOLITIC MOLECULAR SIEVES

[75] Inventors: Chien C. Chao, Millwood; John D. Sherman, Chappaqua, both of N.Y.

[73] Assignee: Union Carbide Corporation, Danbury, Conn.

[21] Appl. No.: 454,655

[22] Filed: Dec. 30, 1982

[51] Int. Cl.[3] ..... C13K 13/00

[52] U.S. Cl. ..... 127/46.3; 127/36; 127/37

[58] Field of Search ..... 127/36, 37, 46.2, 46.3; 536/127; 210/672, 691, 692

[56] References Cited

U.S. PATENT DOCUMENTS

| | | | |
|---|---|---|---|
| 2,882,244 | 4/1959 | Milton | 252/455 |
| 2,985,589 | 5/1961 | Broughton et al. | 210/34 |
| 3,928,193 | 12/1975 | Melaja et al. | 210/31 C |
| 4,008,285 | 2/1977 | Melaja et al. | 127/46.3 X |
| 4,014,711 | 3/1977 | Odawara et al. | 127/46.3 X |
| 4,075,406 | 2/1978 | Melaja et al. | 536/127 |
| 4,182,633 | 1/1980 | Ishikawa et al. | 127/46 A |
| 4,293,346 | 10/1981 | Landis et al. | 127/46 A |
| 4,319,929 | 3/1982 | Fickel | 127/46.2 |
| 4,358,322 | 11/1982 | Neuzil et al. | 127/46.3 X |

OTHER PUBLICATIONS

Chemtech, Aug., 1979, pp. 501, 511.

Chemical Abstracts (1975) vol. 82, 17065r.

Whistler, et al., Ed., *Method of Carbohydrate Chem.*, pp. 71–77, Academic Press, 1962.

A. J. de Rosset, et al., "Industrial Applications of Preparative Chromatography, Percolation Processes, Theory and Applications, NATO Advanced Study Institute, Espinho, Portugal, Jul. 17–29, 1978.

*Primary Examiner*—Kenneth M. Schor

*Attorney, Agent, or Firm*—Gary L. Wamer

[57] ABSTRACT

A process for the separation of arabinose is disclosed which comprises the selective adsorption of same on BaX zeolitic molecular sieves. The process is especially useful for separating arabinose from mixtures of sugars containing arabinose.

10 Claims, 5 Drawing Figures

SEPARATION OF ARABINOSE BY SELECTIVE ADSORPTION ON ZEOLITIC MOLECULAR SIEVES

BACKGROUND OF THE INVENTION

1. Field of the Invention

This invention relates to a process for the liquid phase separation and recovery of arabinose from mixtures containing same. More particularly and in a preferred embodiment, this invention relates to such a separation by selective adsorption onto certain types of zeolitic molecular sieves from sugar mixtures containing arabinose.

2. Description of the Prior Art

The carbohydrate chemistry of the human body centers around sugars with 'D' configurations. No human enzyme can synthesize or digest sugars of 'L' configurations. On the other hand, the non-enzymatic chemistry and general properties of L- sugars should be essentially identical to their D- counterparts. It is this combination which is expected to make L- counterparts of such common sugars as L-fructose, L-glucose and L-sucrose ideal diet (i.e., non-nutritive) sweeteners, because they should taste like D- sugars and should be safe, yet cannot be metabolized by human enzymes.

L-fructose, L-glucose and L-sucrose do not occur naturally, but naturally-occurring L-arabinose can be used to make L-glucose which, in turn, can be isomerized to L-fructose which, in turn, can react with L-glucose to make L-sucrose (see, e.g., CHEMTECH, August, 1979, pp. 501 and 511).

L-arabinose is a five-carbon sugar, which can react with cyanide or nitromethane to extend the carbon chain length to six and, in further reactions, remove nitrogen to produce a mixture of L-glucose and L-mannose. Both glucose and mannose are not good sweeteners; L-fructose is a good sweetener. The mixture of sugars has to be separated and further transformed into sweeter sugars. L-mannose can be isomerized to L-glucose and L-glucose can be isomerized to L-fructose.

In nature, L-arabinose often exists as the hemicelluloses L-araban and L-araban-D-galactan, which are found in mesquite gum, cherry gum, peach gum, rye and wheat bran, beet pulp and in the wood of coniferous trees. In some of these sources, the content of these hemicelluloses is substantial. For example, 20–30% of the pectic substance in sugar beet is araban. The wood of genus Larix may contain 25% L-araban-D-galactan. Araban-galactans are water-soluble. They can be isolated in good yield by extraction from wood with water before delignification.

L-arabinose can be obtained by hydrolysis of beet pulp, which gives a mixture of L-arabinose, D-galactose, and sucrose. If stronger hydrolysis conditions are used, the product mixture will also contain glucose and fructose. If wood is used as a raw material, the product mixture will contain mannose and xylose. In order to realize the potential of L-sugars as diet sweeteners, the separation problem must be solved. First, the L-arabinose has to be separated from the other sugars in the hydrolyzate. Second, L-glucose has to be separated from L-mannose. Commonly-assigned, copending U.S. patent application Ser. No. 454,646, filed on even date herewith describes an efficient method of separating mannose from glucose and other sugars by adsorption.

The traditional method of L-arabinose purification consists of several steps: first, other sugars are removed by fermentation with yeast; then, some of the fermentaton products are removed by anion exchange and L-arabinose is recovered by crystallization (See, e.g., V. Tibensky, Czech. Pat. No. 153,378, (1974); *C. A.*, (1975), Vol. 82, 17065r; and R. L. Whistler and M. L. Wolfrom, Ed., *Method of Carbohydrate Chem.*, pp. 71–77, Academic Press, 1962). It is the purpose of this invention to provide an efficient method of recovering arabinose from a mixture of sugars.

SUMMARY OF THE INVENTION

The present invention, in its broadest aspects, is a process for the liquid phase separation of arabinose from sugar mixtures or other solutions containing same by selective adsorption on a barium-exchanged type X zeolite molecular sieve. The process generally comprises contacting the solution at a pressure sufficient to maintain the system in the liquid phase with an adsorbent composition comprising a crystalline barium-exchanged aluminosilicate type X zeolite, to selectively adsorb arabinose thereon; removing the non-adsorbed portion of the solution from contact with the adsorbent; and desorbing the adsorbate therefrom by contacting the adsorbent with a desorbing agent and recovering the desorbed arabinose.

DESCRIPTION OF THE PREFERRED EMBODIMENTS

Figure 1:
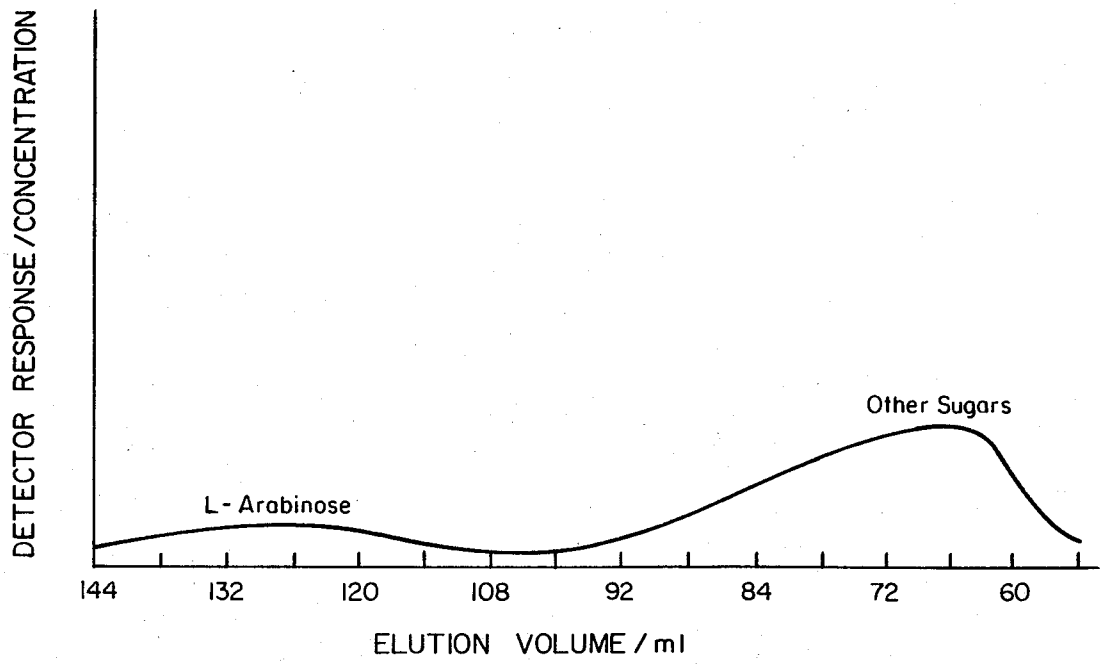
FIG. 1 shows an elution curve of a mixture of 2% L-arabinose, 2% galactose, 2% glucose, 2% mannose and 2% xylose where the adsorbent is a clay-bonded BaX zeolite.

The present invention provides an inexpensive, effective and simple process to recover arabinose from mixtures containing same, such as any of the naturally-derived sources discussed above. Typically, the feed solution comprises a mixture of sugars containing arabinose. The heart of the invention is a BaX zeolite with unique adsorption selectivity. The adsorption selectivities of various zeolites differ, according to their framework structure, silica-to-alumina molar ratio, cation type, and cation concentration. Since the sizes of the cavities inside the zeolites are of the same order of magnitude as the sizes of monosaccharides, the adsorption selectivity of a zeolite is very much dominated by steric factors and thus, is practically unpredictable.

The present invention provides a process for the separation of arabinose from feed solutions containing same. It is expected that the process of the present invention will be useful in separating arabinose from any of the foregoing feed solutions. However, for purposes of convenience only, the discussion which follows will merely generally describe the present invention in terms of separating arabinose from feed solutions containing same, although it is to be expressly understood that the present invention is expected to be useful in separating arabinose from any of the feed solutions identified above.

The process of the present invention is expected to be useful for the separation of both L- and D- arabinose from mixtures containing either form. However, for purposes of convenience only, the discussion which follows will describe the invention only in terms of separating the L-arabinose from mixtures containing same.

As stated above, the purified product of water extraction of wood or beet pulp contains L-arabinose, D-galactose and also, depending on the conditions of hydrolysis and the raw material, sucrose, cellobiose, glucose, fructose, mannose and/or xylose. Such products may be further processed to convert some of their components or to separate and/or purify the liquid. Therefore, as used herein, any reference to such products includes not only the direct liquid product of these processes but also any liquid derived therefrom such as by separation, purification or other processing or any predecessor liquid.

Zeolite molecular sieves (hereinafter "zeolites") are crystalline aluminosilicates which have a three-dimensional framework structure and contain exchangeable cations. The number of cations per unit cell is determined by its silica-to-alumina molar ratio and the cations are distributed in the channels of the zeolite framework. Carbohydrate molecules can diffuse into the zeolite channels, and then interact with the cations and be adsorbed onto them. The cations are, in turn, attracted by the aluminosilicate framework which is a gigantic, multiply-charged anion.

The adsorption selectivity of zeolites depends on the concerted action of a number of factors, as pointed out above, and hence the adsorption selectivities of zeolites are highly unpredictable. However, BaX zeolites have been discovered to adsorb L-arabinose substantially more strongly than other sugars. Therefore, BaX zeolites are ideally suited for the application of L-arabinose recovery, because they selectively adsorb L-arabinose over glucose, fructose, galactose, mannose, xylose, cellobiose, and sucrose. The adsorption capacity of BaX for L-arabinose is substantial. In a column breakthrough test with 10% L-arabinose feed solution, the BaX mesh which contained 20% clay binder adsorbed 6.5 wt % arabinose.

Zeolite X and the method for its manufacture are described in detail in U.S. Pat. No. 2,882,244, issued Apr. 14, 1959 to R. M. Milton. The disclosure of said patent is hereby incorporated herein by reference.

Typically, X zeolites are prepared in sodium form and the sodium cations may be partially or wholly exchanged by different cations, such as barium, using known techniques. For purpose of the present invention, the useful BaX zeolites may be only partially or may be wholly barium-exchanged. Specifically, the cations of the BaX zeolite may be substantially all barium or only partially barium with the balance being other monovalent cations such as sodium or potassium or other cations. The degree of cation exchange is not critical as long as the desired degree of separation is achieved.

Data suggest specific cation-sugar interactions are responsible for the unique sorption selectivities exhibited by the BaX zeolites useful in this invention. It is known that the number of exchangeable barium cations in such zeolites will decrease as the $SiO_2/Al_2O_3$ molar ratio increases and also that, as the monovalent $Na^+$ ions are replaced by divalent $Ba^{++}$ ions, the total number of cations per unit cell decreases. It is also known that within the X crystal structure there exist many different sites at which the barium cations may be located, and that some of these sites are located in positions outside of the supercages in these crystal structures. Since the sugar molecules will enter only the supercage portions of the crystal structure, it is expected that they will interact strongly only with those cations located within or on the edge of the supercages. The number and locations of the Ba cations in each crystal structure will therefore depend upon the sizes and numbers of the cations present and the $SiO_2/Al_2O_3$ molar ratio of the X zeolite. While not wishing to be bound by theory, it is also expected that optimal sorption selectivity will be obtained when particular sugar molecules are presented with an opportunity, through steric considerations, to interact with a particular number of divalent barium cations in or on the edge of the supercage. Therefore, it is expected that optimal sorption selectivities will exist at particular barium exchange levels of the X zeolite and may also exist at particular $SiO_2/Al_2O_3$ molar ratios.

The adsorption affinities of various zeolites for different sugars was determined by a "pulse test". This test consisted of packing a column with the appropriate zeolite, placing it in a block heater to maintain constant temperature, and eluting sugar solutions through the column with water to determine the retention volume of solute. The retention volume of solute is defined as elution volume of solute minus "void volume". "Void volume" is the volume of solvent needed to elute a nonsorbing solute through the column. A soluble polymer of fructose, inulin, which is too large to be sorbed into the zeolite pores, was chosen as the solute to determine void volume. The elution volume of inulin was first determined. The elution volumes of other sugars were then determined under similar experimental conditions. The retention volumes were calculated and are recorded in Table I, below. From the retention volume data, the separation factors (S.F.),

| | | | |
|---|---|---|---|
| αArabinose Glucose | αArabinose Fructose | αArabinose Mannose | αArabinose Sucrose |
| αArabinose Galactose | αArabinose Xylose and | | αArabinose Cellobiose |

were calculated for a BaX zeolite in accordance with the following typical equation:

$$S.F._{A/G} = \alpha^{L\text{-}arabinose}_{D\text{-}Galactose} = \frac{\text{(retention of volume for L-arabinose peak)}}{\text{(retention volume for D-Galactose peak)}}$$

A $S.F._{A/G}$ factor greater than unity indicates that the particular adsorbent was selective for L-arabinose over D-Galactose and similarly for the other separation factors shown in Table II. The separation factor values calculated according to the above-mentioned method are found in Table II for BaX. The NaX and BaX zeolites in Table I each have a $SiO_2/Al_2O_3$ molar ratio of about 2.5.

TABLE I

| Zeolite | Inulin | L-Arabinose | D-Galactose | D-Glucose | D-Fructose | D-Mannose | D-Xylose | Cellobiose | Sucrose |
|---|---|---|---|---|---|---|---|---|---|
| | | | Corrected Retention Volumes of Sugars (in mls) | | | | | | |
| | | | Column Dimension: | 40 cm length × 0.77 cm ID | | | | | |
| | | | Flow Rate: | 1.0 ml/min | | | | | |
| | | | Temperature: | 70° C. | | | | | |
| BaX Powder | 0 | 16.8 | 4.0 | 3.0 | 5.8 | 8.2 | 5.4 | 0.4 | 0.2 |
| NaX Powder | 0 | 2.0 | 1.0 | 1.5 | 2.0 | 1.5 | 1.0 | <0.5 | <0.5 |

TABLE II

| Separation Factors of Sugars | |
|---|---|
| Arabinose Galactose = 4.2 | Arabinose Xylose = 3.1 |
| Arabinose Glucose = 5.6 | Arabinose Cellobiose = 42.0 |
| Arabinose Fructose = 2.9 | Arabinose Sucrose = 84.0 |
| Arabinose Mannose = 2.1 | |

In separating L-arabinose by the process of the present invention, a bed of solid BaX zeolite adsorbent is preferentially loaded with adsorbates, the unadsorbed or raffinate mixture is removed from the adsorbent bed, and the adsorbed L-arabinose is then desorbed from the zeolite adsorbent by a desorbent. The adsorbent can, if desired, be contained in a single bed, a plurality of beds in which conventional swing-bed operation techniques are utilized, or a simulated moving-bed counter-current type of apparatus, depending upon the zeolite and upon which adsorbates are being adsorbed. Thus, one can employ a chromatographic elution method (such as that described in U.S. Pat. No. 3,928,193, the disclosure of which is hereby incorporated herein by reference) to recover L-arabinose in pure form.

Various modifications of this process are possible and will be obvious to those skilled in the art. For exaxmple, after loading the zeolite bed to near the point at which L-arabinose begins to break through and appear in the effluent, the feed can be switched to a stream of pure L-arabinose in water, which can be passed through the bed to displace the non-L-arabinose components from the sorbent and from the void spaces in the bed. When these non-L-arabinose components have been adequately displaced from the bed, the bed can be desorbed with water to recover the L-arabinose from the sorbent and voids. For example, a fixed bed loading/co-current product purge/counter-current desorption cycle may be particularly attractive when the L-arabinose is present at low concentrations and it is desired to recover it at higher purity levels.

A preferable method for practicing the process of this invention is separation by chromatographic column. For example, a chromatographic elution method may be employed. In this method, feed solution is injected as a "slug" for a short period of time at the top of a column and eluted down through the column with water. As the mixture passes through the column, chromatographic separation leads to a zone increasingly enriched in the adsorbed sugar. The degree of separation increases as the mixture passes further down through the column until a desired degree of separation is achieved. At this point, the effluent from the column may be first shunted to one receiver which collects a pure product. Next, during the period of time when there is a mixture of sugars emerging from the column, the effluent may be directed towards a "receiver for mixed product". Next, when the zone of adsorbed sugar emerges from the end of the column, the effluent may be directed to a receiver for that product.

As soon as the chromatographic bands have passed far enough through the column, a new slug is introduced at the entrance of the column and the whole process cycle is repeated. The mixture which exits from the end of the column between the times of appearance of the pure fractions may be recycled back to the feed and passed through the column again, to extinction.

The degree of separation of the peaks as they pass through this chromatographic column will increase as the column length is increased. Therefore, one can design a column of sufficient length to provide a desired degree of separation of the components from each other.

Therefore, it is also possible to operate such a process in a mode which will involve essentially no recycle of an unseparated mixture back to the feed. However, if high purities are required, such a high degree of separation may require an exceptionally long column. In addition, as the components are eluted through the column, their average concentrations gradually decline. In the case of the sugars being eluted with water, this would mean that the product streams would be increasingly diluted with water. Therefore, it is highly likely that an optimum process (to achieve high degrees of purity of the components) should involve the use of a much shorter column (than would be required for complete separation of the peaks) and also involve separating out the portion of the effluent containing the mixture of peaks and recycling it to feed, as discussed above.

Another example of an operable chromatographic separation method is a simulated moving bed process (e.g., as described in U.S. Pat. Nos. 2,985,589, 4,293,346, 4,319,929 and 4,182,633; and A. J. de Rosset et al "Industrial Applications of Preparative Chromatography", Percolation Processes, Theory and Applications, NATO Advanced Study Institute, Espinho, Portugal, July 17–29, 1978 the disclosures of which are hereby incorporated herein by reference) for extracting L-arabinose from typical feed solutions.

In the operation of a simulated moving-bed technique, the selection of a suitable displacing or desorbing agent or fluid (solvent) must take into account the requirements that it be capable of readily displacing adsorbed adsorbate from the adsorbent bed and also that a desired adsorbate from the feed mixture be able to displace adsorbed desorbing agent from a previous step.

Figure 5:
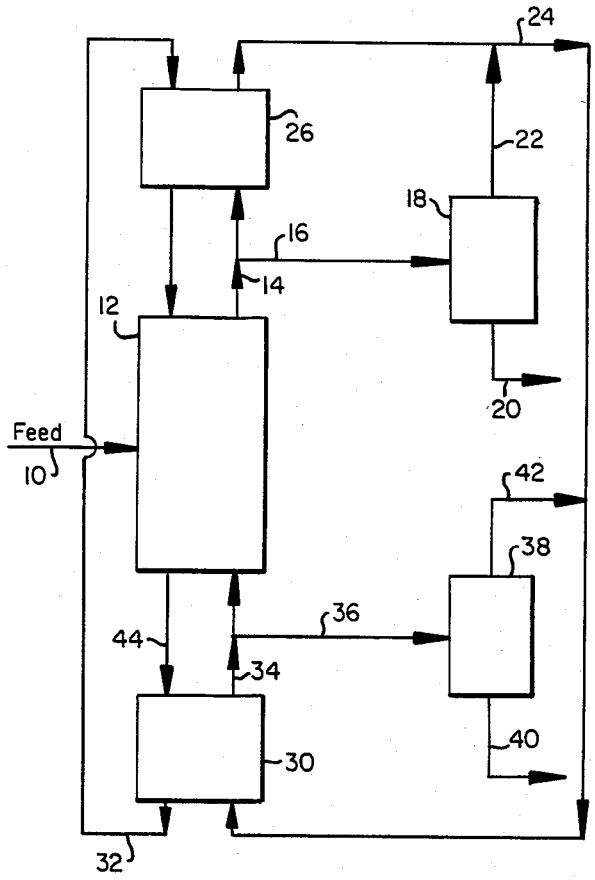
FIG. 5 shows one method in which the process of this invention may be employed.

Another method for practicing the process of this invention is illustrated by the drawing in FIG. 5. FIG. 5 represents the principles of operation of a simulated moving bed system. In the exemplified method, a number of fixed beds may be connected to one another by conduits which are also connected to a special valve (e.g., of the type described in U.S. Pat. No. 2,985,589, the disclosure of which is hereby incorporated herein by reference). The valve sequentially moves the liquid feed and product takeoff points to different positions around a circular array of the individual fixed beds in such a manner as to simulate countercurrent motion of the adsorbent. This process is well-suited to binary separations.

In the drawings, FIG. 5 represents a hypothetical moving-bed countercurrent flow diagram involved in carrying out a typical process embodiment of the present invention. With reference to the drawing, it will be understood that whereas the liquid stream inlets and outlets are represented as being fixed, and the adsorbent mass is represented as moving with respect to the counter flow of feedstock and desorbing material, this representation is intended primarily to facilitate describing the functioning of the system. In practice, the sorbent mass would ordinarily be in a fixed bed with the liquid stream inlets and outlets moving periodically with respect thereto. Accordingly, a feedstock is fed into the system through line 10 to adsorbent bed 12 which contains particles of BaX zeolite adsorbent in transit downwardly therethrough. The component(s) of the feedstock are adsorbed preferentially on the zeolite particles moving through bed 12, and the raffinate is entrained in the liquid stream of water desorbing agent leaving bed 12 through line 14 and a major portion thereof is withdrawn through line 16 and fed into evaporation apparatus 18 wherein the mixture is fractionated and the concentrated raffinate is discharged through line 20. The water desorbing agent leaves the evaporation apparatus 18 through line 22 and is fed to line 24 through which it is admixed with additional desorbing agent leaving the adsorbent bed 26, and is recycled to the bottom of adsorbent bed 30. The zeolite carrying adsorbed sugar passes downwardly through line 44 into bed 30 where it is counter-currently contacted with recycled desorbing agent which effectively desorbs the sugar therefrom before the adsorbent passes through bed 30 and enters line 32 through which it is recycled to the top of adsorbent bed 26. The desorbing agent and desorbed sugar leave bed 30 through line 34. A portion of this liquid mixture is diverted through line 36, where it passes evaporation apparatus 38, and the remaining portion passes upwardly through adsorbent bed 12 for further treatment as hereinbefore described. In evaporation apparatus 38, the desorbing agent and sugar are fractionated and the sugar product is recovered through line 40 and the desorbing agent is either disposed of or passed through line 42 into line 24 for recycle as described above. The undiverted portion of the desorbing agent/raffinate mixture passes from bed 12 through line 14, enters bed 26 and moves counter-currently upwardly therethrough with respect to the desorbing agent-laden zeolite adsorbent passing downwardly therethrough from recycle line 32. The desorbing agent passes from bed 26 in a relatively pure form through recycle line 24 and to bed 30 as hereinbefore described.

In any of the above processes, the desorbing agent employed should be readily separable from admixture with the components of the feed-stock. Therefore, it is contemplated that a desorbing agent having characteristics which allow it to be easily fractionated or volatilized from those components should be used. For example, useful desorbing agents include water, mixtures of water with alcohols, ketones, etc. and possibly alcohols, ketones, etc., alone. The most preferred desorbing agent is water.

While it is possible to utilize the activated BaX zeolite crystals in a non-agglomerated form, it is generally more feasible, particularly when the process involves the use of a fixed adsorption bed, to agglomerate the crystals into larger particles to decrease the pressure drop in the system. The particular agglomerating agent and the agglomeration procedure employed are not critical factors, but it is important that the bonding agent be as inert toward the adsorbate and desorbing agent as possible. The proportions of zeolite and binder are advantageously in the range of 4 to 20 parts zeolite per part binder on an anhydrous weight basis. Alternatively, the agglomerate may be formed by pre-forming zeolite precursors and then converting the pre-form into the zeolite by known techniques.

The temperature at which the adsorption step of the process should be carried out is not critical and will depend on a number of factors. For example, it may be desirable to operate at a temperature at which bacterial growth is minimized. Generally, as higher temperatures are employed, the zeolite may become less stable although the rate of adsorption would be expected to be higher. However, the sugar may degrade at higher temperatures and selectivity may also decrease. Furthermore, too high a temperature may require a high pressure to maintain a liquid phase. Similarly, as the temperature decreases, the sugar solubility may decrease, mass transfer rates may also decrease and the solution viscosity may become too high. Therefore, it is preferred to operate at a temperature between about 4° and 150° C., more preferably from about 20° to 110° C. Pressure conditions must be maintained so as to keep the system in liquid phase. High process temperatures needlessly necessitate high pressure apparatus and increase the cost of the process.

The pH of the fluids in the process of the present invention is not critical and will depend upon several factors. For example, since both zeolites and sugars are more stable near a neutral pH and since extremes of pH's might tend to degrade either or both of the zeolites and sugars, such extremes should be avoided. Generally, the pH of the fluids in the present invention should be on the order of about 4 to 10, preferably about 5 to 9.

It may be desirable to provide a small amount of a soluble barium salt in the feed to the adsorbent bed in order to counteract any stripping or removal of barium cations from the BaX zeolite in the bed. For example, a small amount of barium chloride, etc., may be added to the feed or desorbent in order to provide a sufficient concentration of barium cations in the system to counteract stripping of the barium cations from the zeolite and maintain the zeolite in the desired cation-exchange form. This may be accomplished either by allowing the soluble barium concentration in the system to build up through recycle or by adding additional soluble barium salt when necessary to the system.

The following Examples are provided to illustrate the process of the present invention as well as processes which do not separate L-arabinose. However, it is not intended to limit the invention to the embodiments in the Examples. All examples are based on actual experimental work.

As used in the Examples appearing below, the following abbreviations and symbols have the indicated meaning:

NaX: Sodium-exchanged zeolite X
BaY: Barium-exchanged zeolite Y
BaX: Barium-exchanged zeolite X
ml/min: milliliters per minute.

EXAMPLE 1

A 160 cm stainless steel column having an inside diameter of 0.77 cm was loaded with BaX zeolite bonded into 30×50 mesh with 20% clay. The column was filled with water and maintained at a temperature of 70° C. Water was then pumped through the column and a flow rate of 0.2 ml/min was maintained. For a period of five minutes, the feed was switched to a mixture which contained 2 weight % L-arabinose, 2 weight % galactose, 2 weight % glucose, 2 weight % mannose and 2 weight % xylose, and then switched back to water. The composition of the effluent from the column was monitored by a differential refractometer. FIG. 1 of the drawings shows the elution curve of the effluent. All of the sugars, except L-arabinose, appeared as one peak. L-arabinose eluted as a peak by itself.

EXAMPLE 2

Figure 2:
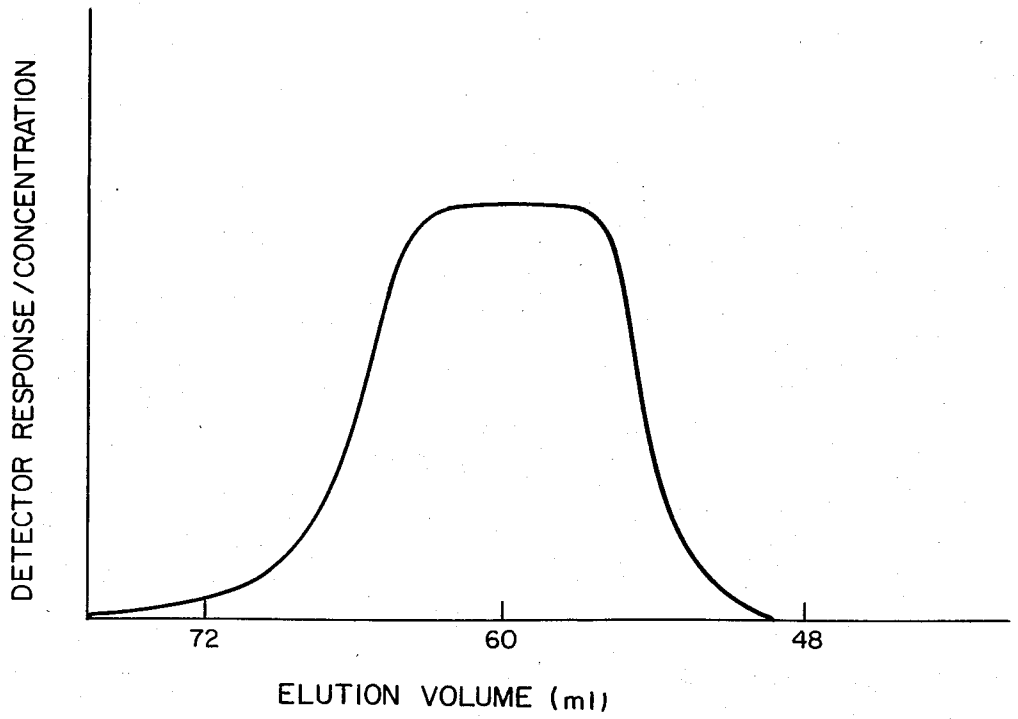
FIGS. 2 and 3 show elution curves of the same mixture where the adsorbents are a clay-bonded NaX zeolite and a clay-bonded BaY zeolite, respectively.

The same column and experimental conditions as in Example 1 were used except that the zeolite used was a clay-bonded 30×50 NaX mesh. FIG. 2 gives the elution curve of the effluent. All sugars, including L-arabinose, eluted as a single, relatively narrow peak. No significant separation was observed although the sugars in the feed may be individually detected by appropriate adjustments in the detector.

EXAMPLE 3

Figure 3:
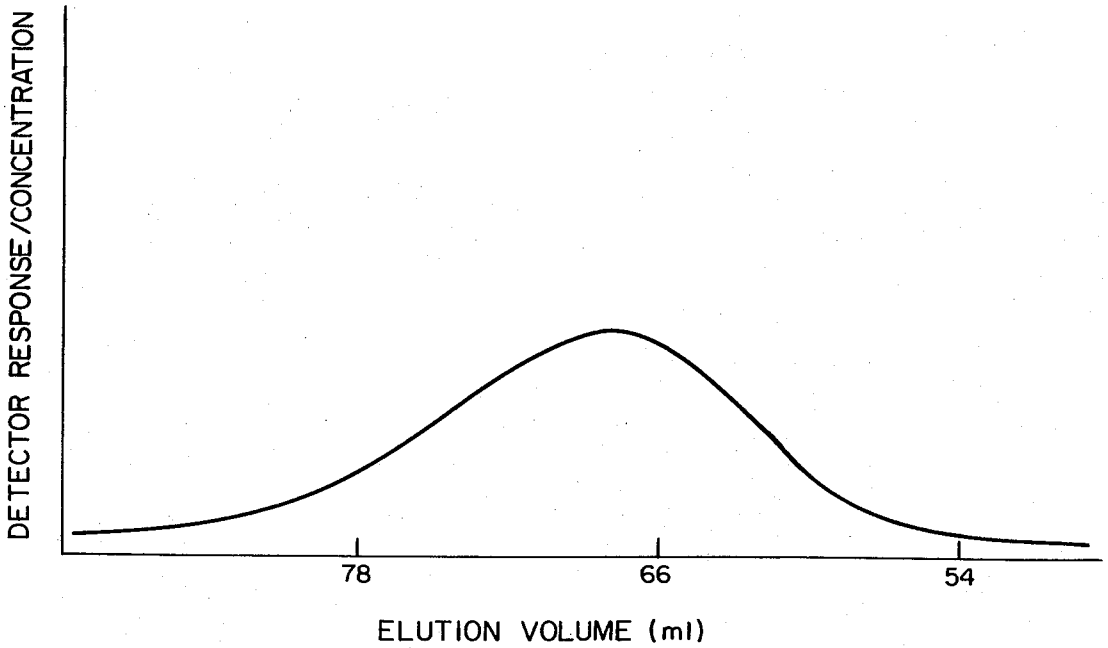

The same column and experimental conditions as in Example 1 were used except that the zeolite in the column was a clay-bonded BaY zeolite, the feed was a mixture which contained 2 weight % L-arabinose and 2 weight % D-galactose and the flow rate was 1 ml/min. FIG. 3 gives the elution curve of the effluent. L-arabinose and D-galactose were not significant separated.

EXAMPLE 4

Figure 4:
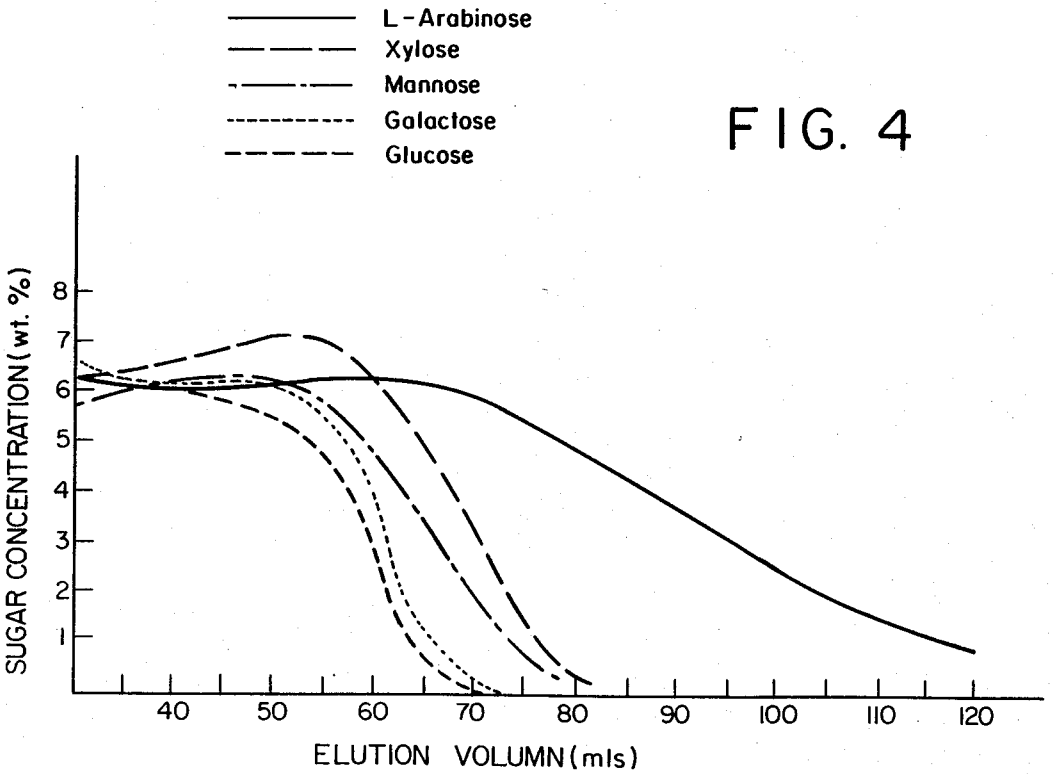
FIG. 4 shows a desorption curve obtained from a mixture of the same sugars but in amounts of 6% each where the adsorbent is a clay-bonded BaX zeolite.

The same column and experimental conditions as in Example 1 were used except that the feed was changed to a mixture which contained 6 weight % of each of the five sugars identified in Example 1. The feed flowed continuously through the column until it reached equilibrium with the BaX bed. The bed was then desorbed with water. A total of about 1.1 grams of pure L-arabinose was recovered from the effluent. The desorption curve is given in FIG. 4.

It is, of course, well-known to those skilled in the art that in chromatographic-type separations of these types, improvements in the degrees of observed separation are to be expected when longer columns are employed, when smaller quantities of sorbates are injected, when smaller zeolite particles are used, etc. However, the above results are sufficient to demonstrate to those skilled in the art the technical feasibility of performing these separations by the use of any type of chromatographic separation processes known in the art. Furthermore, various fixed bed loading/regeneration type of cyclic adsorption processes can also be employed to perform the above separtions.

The following Table III summarizes the compositions of the various zeolites employed in the foregoing examples:

TABLE III

| Zeolite | Cation Exchange Level in Zeolite (Equivalent Percent)* | |
|---|---|---|
| | Na+ | Ba++ |
| NaX | ca 100 | — |
| BaX | 1 | 99 |
| BaY | 30 | 70 |

*$([R^{n+}_{2/n}O]/[Na_2O + BaO])$ mole ratio × 100.

What is claimed is:

1. A selective adsorption process for the separation of arabinose from a liquid mixture containing arabinose and at least one other aldose, which process comprises: (a) contacting said liquid mixture, at a pressure sufficient to maintain the mixture in a liquid phase, with an adsorbent composition comprising a BaX crystalline aluminosilicate zeolite, whereby arabinose is selectively adsorbed thereon; (b) removing the non-adsorbed portion of said liquid mixture from contact with the adsorbent composition; and (c) desorbing arabinose from said adsorbent composition by contacting said adsorbent composition with a desorbing agent and recovering desorbed arabinose.

2. A process in accordance with claim 1 wherein the temperature is from about 4° C. to about 150° C.

3. A process in accordance with claim 1 wherein the temperature is from about 20° C. to about 110° C.

4. A process in accordance with claim 1 wherein the desorbent is selected from the group consisting of water and mixtures thereof with alcohols or ketones.

5. A process in accordance with claim 1 wherein the desorbent is water.

6. A process in accordance with claim 1 wherein said mixture comprises a mixture of sugars.

7. A process in accordance with claim 6 wherein said sugar mixture contains arabinose and at least one of galactose, sucrose, glucose, fructose, mannose, xylose and cellobiose.

8. A process in accordance with claim 1 wherein said mixture comprises a mixture of sugars derived from the hydrolysis of wood.

9. A process in accordance with claim 1 wherein said mixture comprises the hydrolysis product of beet pulp.

10. A selective adsorption process for the separation of a rabinose from a liquid mixture containing a arabinose and at least one of galactose, glucose, mannose, xylose, cellobiose and sucrose, wherein said process comprises:

(a) contacting said liquid mixture at a pressure sufficient to maintain the mixture in a liquid phase, with an adsorbent composition comprising a BaX crystalline aluminosilicate zeolite, whereby arabinose is selectively adsorbed thereon;

(b) removing the non-adsorbed portion of said liquid mixture from contact with the adsorbent composition; and (c) desorbing arabinose from said adsorbent composition by contacting said adsorbent composition with a desorbing agent and recovering desorbed arabinose.

* * * * *